United States Patent [19]

Inagaki et al.

[11] Patent Number: 4,557,670

[45] Date of Patent: Dec. 10, 1985

[54] COMPRESSOR

[75] Inventors: Mitsuo Inagaki; Seitoku Ito, both of Okazaki; Kenji Takeda, Aichi; Yoshiki Kurokawa, Okazaki, all of Japan

[73] Assignees: Nippon Soken, Inc., Nishio; Nippondenso Co. Ltd., Kariya, both of Japan

[21] Appl. No.: 472,992

[22] Filed: Mar. 7, 1983

[30] Foreign Application Priority Data

Mar. 9, 1982 [JP] Japan ..... 57-35743

[51] Int. Cl.[4] ..... F04B 49/02

[52] U.S. Cl. ..... 417/299; 417/309; 417/310

[58] Field of Search ..... 417/299, 301, 309, 310, 417/311

[56] References Cited

U.S. PATENT DOCUMENTS

| | | | |
|---|---|---|---|
| 2,657,850 | 11/1953 | Borel | 417/309 |
| 3,224,662 | 12/1965 | Oldberg | 417/309 X |
| 3,676,021 | 7/1972 | Wayner | 417/299 |
| 4,080,110 | 3/1978 | Szymaszek | 417/309 X |
| 4,344,297 | 8/1982 | Uero et al. | 417/299 X |
| 4,441,863 | 4/1984 | Hotta et al. | 417/505 X |

FOREIGN PATENT DOCUMENTS

| | | | |
|---|---|---|---|
| 159582 | 12/1981 | Japan | 417/309 |
| 2083868 | 3/1982 | United Kingdom | 417/299 |

*Primary Examiner*—William L. Freeh
*Assistant Examiner*—Theodore Olds
*Attorney, Agent, or Firm*—Cushman, Darby & Cushman

[57] ABSTRACT

A compressor bypass passage has an inlet portion and an outlet portion which is connected to the suction passage. The inlet portion of the bypass passage has an opening which is able to be open to the compression chamber when the compression chamber is in a decreasing volume stroke, thereby to spill the refrigerant from the compression chamber into the suction passage. A control pressure chamber is formed in the housing. A valve member is arranged in the inlet portion of the bypass passage. The valve member is actuated in response to a variety of pressures of the refrigerant in the control pressure chamber for adjusting the area of the opening of the inlet portion of the bypass passage. A pressure supply passage for supplying a refrigerant, which pressure is higher than the pressure in the suction passage, is connected to the control pressure chamber. A spill passage for spilling a part of the refrigerant interconnects the control pressure chamber to the suction passage. A pressure control valve is arranged in the pressure supply passage or in the spill passage for controlling the pressure in the control pressure chamber.

11 Claims, 9 Drawing Figures

COMPRESSOR

BACKGROUND OF THE INVENTION

1. Field of the Invention

The present invention relates to a compressor for use in a refrigerating apparatus, and more particularly, to a compressor for use in a refrigerating apparatus applied in an automobile.

2. Description of the Prior Art

In conventional compressors used in a refrigerating apparatus, there is provided a discharge control device for controlling the amount of refrigerant discharged from the compressor in accordance with the refrigerating apparatus cooling load.

As disclosed in Japanese Examined Patent Publication (Kokoku) No. 50-32450, the known device comprises a bypass passage for spilling a part of the compressed refrigerant from a compression chamber formed in a housing into a suction passage connected to the compression chamber. The amount of the refrigerant spilled from the compression chamber is adjusted by a valve. The valve is actuated by an actuating device controlled by a detector which detects the temperature or pressure of a refrigerant in an evaporator. However, since the actuating device actuates the valve by use of the pressure of oil supplied from an oil pump, it is necessary to provide supplemental oil pressure equipment on the housing.

SUMMARY OF THE INVENTION

An object of the present invention is to provide a compressor, capable of adjusting the amount of the refrigerant discharged from the compressor in accordance with the cooling load of the refrigerating apparatus without having to provide supplemental oil pressure equipment for actuating the valve.

In accordance with the present invention, there is provided a compressor for use in a refrigerating apparatus comprising: a housing having therein at least one movable compression chamber which has volume varying in accordance with the movement of the compression chamber; a suction passage arranged in the housing and connected to the compression chamber when the compression chamber is in a suction stroke, thereby to feed a refrigerant into the compression chamber; a discharge passage arranged in the housing and connected to the compression chamber when the compression chamber is in a discharge stroke, thereby to discharge the refrigerant from the compression chamber; a bypass passage having an inlet portion and an outlet portion which is connected to the suction passage, the inlet portion having an opening which is able to be open to the compression chamber when the compression chamber is in a decreasing volume stroke, thereby to spill the refrigerant from the compression chamber into the suction passage; valve means having a control pressure chamber formed in the housing and a valve member which is arranged in the inlet portion of the bypass passage and is actuated in response to a variety of pressures of the refrigerant in the control pressure chamber for adjusting the area of the opening of the inlet portion of the bypass passage; pressure supply means arranged in the housing and connected to the control pressure chamber for supplying a refrigerant, which pressure is higher than the pressure in the suction passage, and increasing the pressure in the control pressure chamber; a spill passage arranged in the housing and interconnecting the control pressure chamber to the suction passage for spilling a part of the refrigerant in the control pressure chamber into the suction passage and decreasing the pressure in the control pressure chamber; and pressure control means for controlling the ratio of the amount of the refrigerant to be supplied into the control pressure chamber to the amount of the refrigerant to be spilled from the control pressure chamber so as to control the pressure in the control pressure chamber.

DETAILED DESCRIPTION OF THE PREFERRED EMBODIMENT

Figure 1:
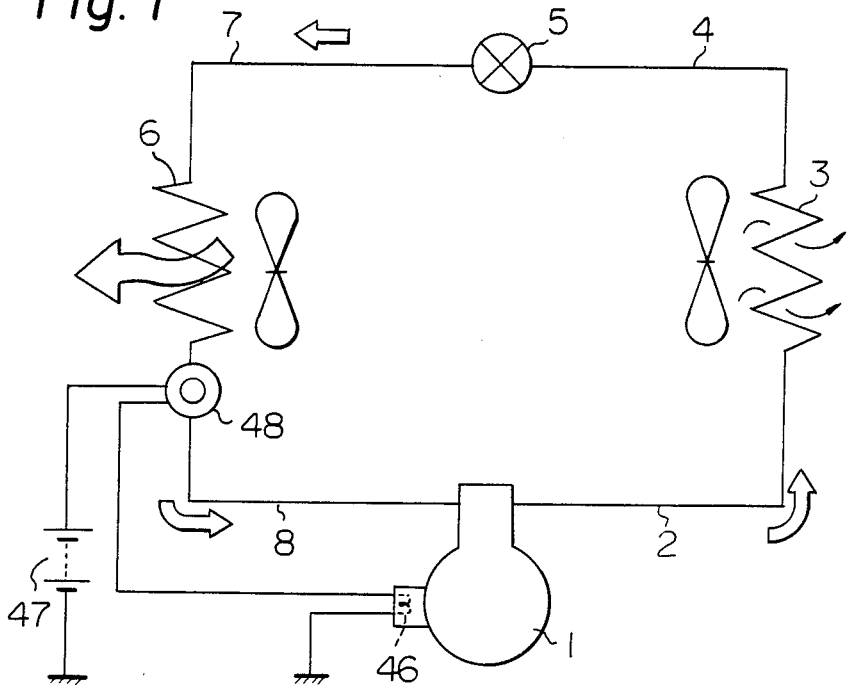
FIG. 1 is a schematic view of a compressor used in a refrigerating apparatus according to a first embodiment of the present invention.

Referring to FIG. 1, in a refrigerating apparatus for cooling a compartment of an automobile, a compressor 1 for compressing and discharging a refrigerant is connected via a conduit 2 to a condenser 3 for condensing and liquefying the high-temperature high-pressure gasified refrigerant discharged from the compressor 1. The condenser 3 is connected via a conduit 4 to a pressure reducing device or expansion valve 5 for expanding under reduced pressure the liquefied refrigerant into a low-temperature low-pressure mist. An evaporator 6 for evaporating or gasifying the refrigerant is connected to a pressure reducing device or an expansion valve 5 via a conduit 7 and to the compressor 1 via a conduit 8. The evaporator 6 is arranged within an air duct (not shown) for feeding air into the automobile compartment. Heat exchange is performed between air in the air duct and the refrigerant by the evaporator 6, and air in the air duct is deprived of evaporation heat of the refrigerant to effect cooling of the automobile compartment.

The compressor 1 is driven by an automobile engine (not shown) via power transmitting means (not shown) comprising a V-belt, pulleys, and an electromagnetic clutch which is turned off to stop the operation of the compressor 1 when cooling of the automobile compartment is not necessary.

Figure 2:
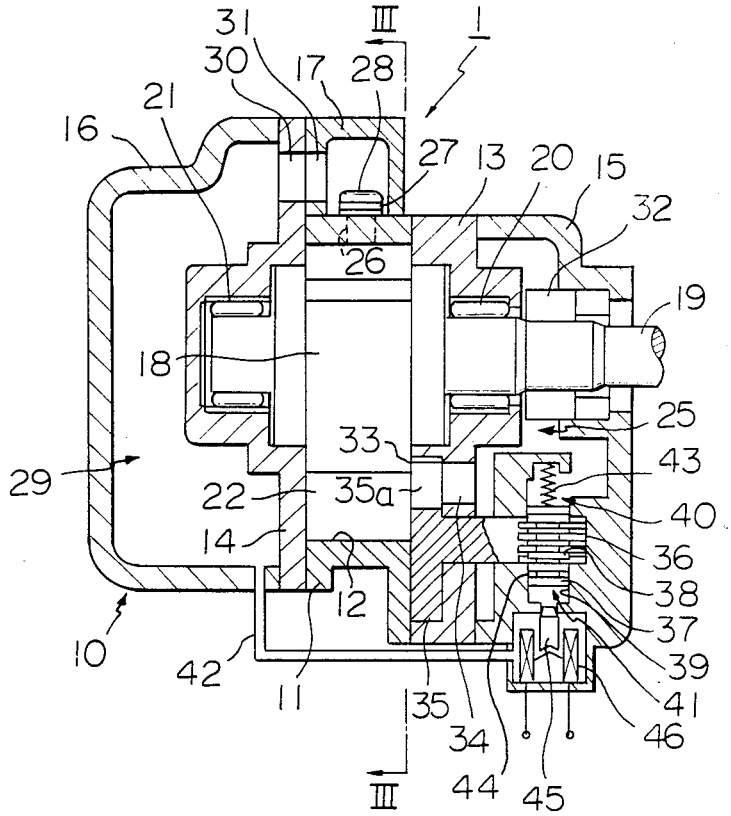
FIG. 2 is a view of a section of the compressor.
Figure 3:
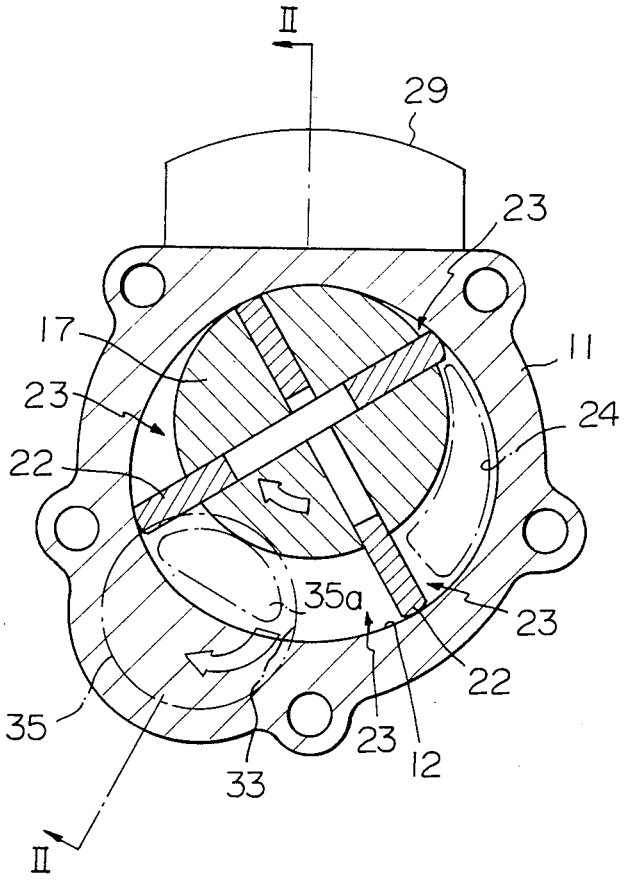
FIG. 3 is a view of a section of the compressor taken along the line III—III in FIG. 2.

Referring to FIGS. 2 and 3 illustrating the internal structure of the compressor 1, a housing 10 of the compressor 1 comprises a center housing member 11 having a cylindrical bore 12 which extends between both ends of the center housing member. A front end plate 13 is arranged on the one end of the center member 11 and a rear end plate 14 is arranged on the other end of the center member 11. A front housing member 15 is arranged on the front end plate 13 and a rear housing member 16 is arranged on the rear end plate 14. A valve housing member 17 is arranged between the outside face of the center housing member 11 and the rear end plate 14. These four housing members and end plates are rigidly held together in a conventional manner.

A rotor 18 is eccentrically arranged in the cylindrical bore 12 of the center housing member 11 and integrated with a drive shaft 19 which is rotatably supported on the end plates 13 and 14 via bearings 20 and 21, respectively. The drive shaft 19 extends to the exterior of the housing 10 through the front housing member 15 and receives the drive power of the engine through the electromagnetic clutch.

Two vanes 22 are slidably inserted into the rotor 18 in diametrical directions so that both tip ends of each vane 22 are always brought into contact with inner walls of the center housing member 11 and the end plates 13 and 14 when the rotor 18 is rotated in the clockwise direction in FIG. 3. Four variable compression chambers 23 are defined by the center housing member 11, the rotor 18, the front end plate 13, the rear end plate 14, and the vanes 22. The volume of each compression chamber 23 is varied repeatedly when the rotor 18 and vanes 22 are rotated in the clockwise direction in FIG. 3.

An inlet port 24 is formed on the front end plate 13 so that the port 24 is connectable to at least one compression chamber 23 when the compression chamber 23 is in a suction stroke. A suction pressure chamber 25 which constructs a part of a suction passage is formed between the front end plate 13 and the front housing member 15, and the chamber 25 is connected to the inlet port 24. The evaporator 6 is connected to the suction pressure chamber 25 through the conduit 8 and a suction port (not shown) formed on the front housing member 15.

An outlet port 26 for interconnecting at least one compression chamber 23 to the interior of the valve housing member 17 when the compression chamber 23 is in a discharge stroke, is formed on the center housing member 11. A discharge valve 27 and a valve stopper 28 are arranged in the interior of the valve housing member 17. A discharge pressure chamber 29 which constructs a part of a discharge passage is formed between the rear end plate 14 and the rear housing member 16, and the chamber 29 is connected to the interior of the valve housing member 17 through ports 30 and 31 so that when the valve 27 is opened, the discharge pressure chamber 29 is connected to the compression chamber 23 through the ports 30 and 31, the interior of the valve housing member 17, and the outlet port 26. The condenser 3 is connected to the discharge pressure chamber 29 through the conduit 2 and a discharge port (not shown) formed on the rear housing member 16. A shaft seal device 32 is arranged between the drive shaft 19 and the front housing member 15 in order to prevent the refrigerant or lubricating oil from leaking to the exterior of the housing 10 along the drive shaft 19.

A bypass passage for spilling a part of the refrigerant from a compression chamber 23 into the suction pressure chamber 25 has an inlet portion 33 and an outlet portion 34 which are formed in the front end plate 13. An outlet portion 34 is connected to the suction pressure chamber 25, and a part of the inlet portion is able to be open to at least one compression chamber 23 when the compression chamber is in a decreasing volume stroke. A rotary valve 35 is arranged in the inlet portion 33. The rotary valve 35 has a port **35*a* which forms an opening of the inlet portion 33. The opening area of the port 35*a* to a compression chamber 23 is varied in accordance with the rotation of the valve 35. Therefore, the amount of the refrigerant spilled from a compression chamber 23 into the suction pressure chamber 25 is varied in accordance with the rotation of the valve 35**.

A pinion 36 is integrated with the rotary valve 35, and a piston 37 provided with a rack 38 to be engaged with the pinion 36 is arranged in a cylinder 39 formed in the front housing member 15 so that the piston 37 can make reciprocative movement without rotation. In the cylinder 39, a suction pressure introduction chamber 40 and a control pressure chamber 41 are formed at each end of the piston 37, respectively and the suction pressure introduction chamber 40 is always communicated with the suction pressure chamber 25.

Reference numeral 42 represents a pressure supply passage for supplying a pressure of the refrigerant from the discharge pressure chamber 29 into the control pressure chamber 41. One end of the pressure supply passage 42 is connected to the control pressure chamber 41 while the other end is connected to the discharge pressure chamber 29.

The pressure of the refrigerant in the control pressure chamber 41 can leak toward the suction pressure chamber 25 through a narrow gap 44 between the piston 37 and the cylinder 39.

The gap 44 forms a spill passage for spilling a refrigerant from the chamber 41 into the chamber 25. When the pressure in the control pressure chamber 41 is reduced below a load set by a spring 43, the piston 37 is pushed toward the control pressure chamber 41, whereby the rotary valve 35 is rotated in the closing direction.

In the interior of the housing 10, there are intermediate pressure spaces in which a pressure between the pressure in the discharge pressure chamber 29 and the pressure in the suction pressure chamber 25 is introduced, such as gap spaces between the drive shaft 19 and the bearings 21 and 20. Accordingly, the pressure supply passage 42 may comprises such an intermediate pressure spaces.

Figure 4:
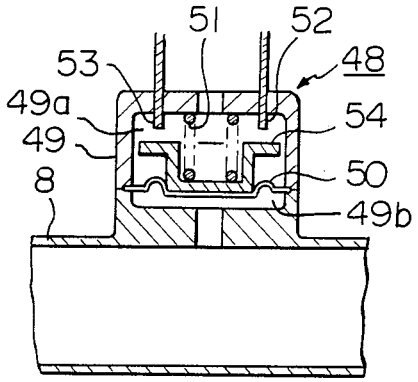
FIG. 4 is a sectional view of a pressure detector in FIG. 1.

A pressure control valve 45 is arranged in the pressure supply passage 42 to switch on and off the supply of the pressure of the refrigerant to the control pressure chamber 41. The valve 45 is actuated by a solenoid coil 46 attached to the housing 10. As shown in FIG. 1, the coil 46 is connected to a power source 47 through a pressure detector (i.e. sensor) 48 for detecting (i.e. sensing) the pressure in the suction passage of the housing 10. In this embodiment, as shown in FIG. 4, the pressure detector 48 comprises a switch case 49 arranged in the conduit 8. A diaphragm 50 is disposed in a switch case 49, and the interior of the switch case 49 is divided into an atmospheric pressure space **49*a* and the suction pressure space 49*b* which is connected to the interior of the conduit 8. A spring 51 is arranged on the atmospheric pressure space 49*a* of the switch case 49 to impose a load corresponding to a predetermined pressure on the diaphragm 50. Stationary contacts 52 and 53 of a switch are arranged in the switch case 49, and a movable contact member 54 of the switch is mounted on the diaphragm 50. The predetermined load of the spring 51 is set so that the stationary contacts 52 and 53 are caused to fall in contact with the movable contact member 54 when the pressure at the outlet of the evaporator 6 which is substantially equal to the pressure in the suction passage in the housing 10 of the compressor 1** is, for example, not less than 1.85 kg/cm$^2$.

The operation of the compressor having the above-mentioned structure will now be described.

Figure 5:
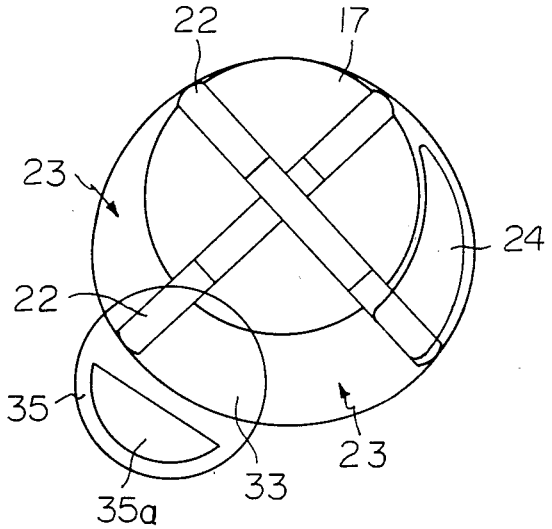
FIGS. 5 and 6 are diagrams of a section of the compressor, which illustrate the operation states in the first embodiment.

When the rotational speed of the engine is small and the cooling load of the refrigerating apparatus is high, the pressure in the evaporator 6 is high and exceeds the predetermined pressure, that is, 1.85 kg/cm$^2$. Accordingly, the diaphragm 50 of the pressure detector 48 pushes the movable contact member 54 to the stationary contacts 52 and 53 against the spring 51. Therefore, the switch of the pressure detector 48 is turned on. When the switch is turned on, an electric current from the power source 47 flows in the coil 46 to open the valve 45, whereby the pressure in the discharge pressure chamber 29 is introduced into the control pressure chamber 41 and the piston 37 is moved toward the suction pressure introduction chamber 40 against the spring 43. At this time, the piston 37 gives a rotation in the clockwise direction in FIG. 3 to the rotary valve 35, and the inlet port 35*a* of the bypass passage is moved outward with respect to the radial direction of the compression chamber 23, as shown in FIG. 5. Accordingly, the refrigerant is discharged from the compressor 1 in a maximum volume, and a sufficient cooling effect can be attained.

Figure 6:
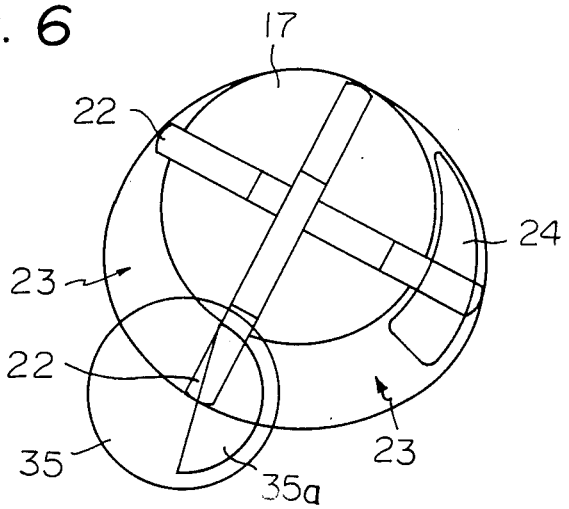

When the rotational speed of the vehicle engine is large and the cooling load of the refrigerating apparatus is reduced to reduce the pressure of the refrigerant in the evaporator below the predetermined pressure of the pressure switch 48, that is, 1.85 kg/cm$^2$, the switch of the detector 48 is turned off and the supply of an electric current to the coil 46 is stopped, whereby communication of the pressure supply passage 42 with the control pressure chamber 41 is cut by the valve 45. Accordingly, the pressure in the control pressure chamber 41 leaks toward the suction pressure chamber 25 and becomes close to the pressure in the suction pressure chamber 25 and the piston 37 is pushed by the spring 43 and moved toward the control pressure chamber 41. At this time, the piston 37 gives a rotation in the counterclockwise direction in FIG. 3 to the rotary valve 35, and, as shown in FIG. 6, the inlet port 35*a* is partially opened into a compression chamber 23. Accordingly, a part of the refrigerant in the compression chamber 23 in the compression stage is returned from the compression chamber 23 into the suction pressure chamber 25 through the inlet port 35*a* and the port 34, with the result that the amount of the refrigerant discharged from the compressor 1 is reduced.

When the amount of the discharged refrigerant from the compressor 1 is reduced, the amount of the refrigerant passing through the interior of the evaporator 6 is reduced. Therefore, the pressure of the refrigerant in the evaporator 6 is increased and exceeds the predetermined pressure and the switch of the pressure detector 48 is turned on again, whereby the rotary valve 35 is rotated in the clockwise direction in FIG. 3 to increase the amount of the refrigerant discharged from the compressor 1 and the pressure of the refrigerant in the evaporator 6 is reduced below the predetermined pressure of the pressure detector 48.

In actual operation, since the switch of the pressure detector 48 is turned on and off at a very short frequency, the amount of the refrigerant discharged from the compressor is controlled while the rotational angle of the rotary valve 35 is fluctuated with minute amplitudes with the angle corresponding to the rotational speed of the engine and the cooling load as the center. Accordingly, the fluctuation in the temperature of cold air blown out from the air duct through the exterior of the evaporator 6 becomes very small and the stability of the driving torque of the compressor 1 is obtained. Therefore, good comfort in the interior of the compartment and good drivability of the automobile can be obtained.

When the rotational speed of the engine is very large and the cooling load is extremely low, even if the inlet port 35*a* is fully opened to the compression chamber 23, the pressure of the refrigerant in the evaporator 6 is lower than the predetermined pressure. In this case, the operation of the compressor 1 can be switched on and off by turning on and off the above-mentioned electromagnetic clutch, but in this state, the control valve 45 is kept closed and, hence, the suction pressure is maintained in the control pressure chamber 41. Accordingly, the compressor 1 is in the state of the minimum discharge volume and the operation of the compressor 1 is switched on and off in the state of the minimum discharge volume. Therefore, the variaton of the load of the engine is reduced and drivability of the automobile is not degraded at all.

Incidentally, it may be considered that the above-mentioned control valve will be controlled by the output of the temperature detecting circuit which detects, for example, the temperature of cold air or the temperature of the refrigerant at the outlet of the evaporator. In this case, however, since the temperature of the cold air changes gradually in the practical refrigerating apparatus when the temperature of cold air or the refrigerant at the outlet of the evapolator exceeds a certain level, the discharge volume of the compressor is changed to a maximum volume. When the temperature of cold air or the refrigerant at the outlet of the evaporator is reduced below a certain level, the discharge volume of the compressor is abruptly changed to the minimum volume. If the discharge volume of the compressor is thus changed greatly, the variation of the load of the engine is increased, resulting in degradation of the drivability of the automobile.

In order to eliminate the above defect of the system of the temperature detecting type, there may be adopted a method in which the duty ratio of the operation of the solenoid valve is changed according to the temperature of cold air or the refrigerant at the outlet of the evaporator. In this method, however, since the internal pressure (e.g. the pressure in the discharge passage, the pressure in the suction passage, or the like) of the compressor which acts as the force operating the volume controlling mechanism is changed moment by moment, a considerably complicated electric circuit is necessary for enhancing the controlling property.

When the refrigerating apparatus of the pressure detecting type is compared with the above-mentioned temperature detecting type, it is apparent that the refrigerating apparatus of the pressure detecting type is advantageous in that good comfort and good drivability can be attained by a simple structure.

Figure 7:
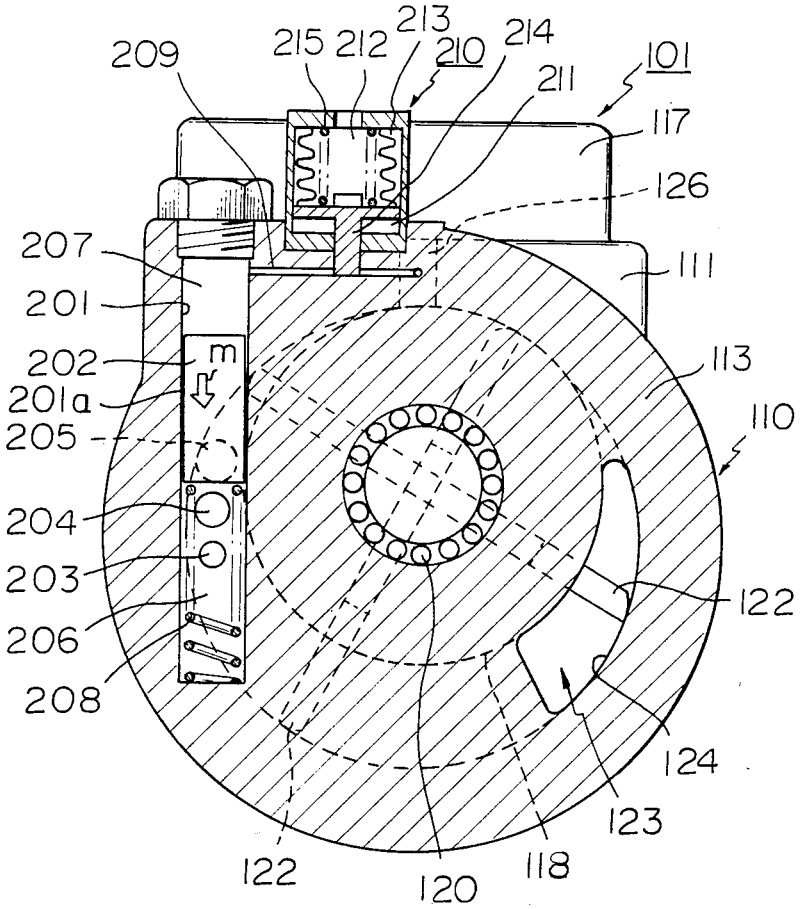
FIG. 7 is a sectional view of a compressor in a refrigerating apparatus according to a second embodiment of the present invention.

In FIG. 7 is shown a part of the compressor according to a second embodiment of the present invention. Referring to FIG. 7, reference numeral 110 represents a housing of a compressor 101, and reference numerals 111, 113, 117, 118, 120, 122, 123, 124, and 126 represent a center housing member of the housing 110, a front end plate of the housing 110, a valve housing member of the housing 110, a rotor, a bearing, vanes, compression chambers, an inlet port, and an outlet port, respectively. A cylinder of the valve means is formed in the front end plate 113, and a piston 202 formed as a valve member of spool type is inserted in the cylinder 201 so that the piston 202 can make reciprocative movement. A plurality of inlet ports 203, 204, and 205 having one end opened to the compression chamber 123 and the other end opened to the interior of the cylinder are formed on the front end plate 113, and an inlet portion of a bypass passage is constructed by these inlet ports 203, 204 and 205.

The interior of the cylinder 201 is divided into a suction pressure introduction chamber 206 and a control pressure chamber 207 by the piston 202. The piston 202 is urged by a spring 208 arranged in the suction pressure introduction chamber 206 to open the inlet ports 203, 204, and 205 in succession. A spill passage comprises a gap 201*a* formed between the piston 202 and the cylinder 201.

The control pressure chamber 207 is communicated with an outlet port 126 of a discharge passage of the compressor 101 through pressure supply passage 209, and a pressure control device 210 is disposed in the pressure supply passage 209 to switch on and off the pressure supply passage 209 according to changes of the pressure of the refrigerant in the suction passage of the compressor. A suction pressure introduction chamber 211 of the pressure control device 210 is communicated with the inlet port 124 of a suction of the compressor 101 through a passage (not shown). The suction pressure introduction chamber 211 is partitioned from an atmospheric pressure chamber 212 by a bellows 213 integrated with a control valve 214. A spring 215 urging the valve 214 in the valve-closing direction is arranged in the atmospheric pressure chamber 212. A spring load corresponding to a pressure of, for example, 1.85 kg/cm$^2$ in the inlet port 124 is set for the spring 215.

In the second embodiment, when the pressure in the inlet port is higher than the predetermined pressure of 1.85 kg/cm$^2$, the valve 214 is opened to introduce the pressure from the outlet port 126 into the control pressure chamber 207. Accordingly, the piston 202 is moved in the direction of arrow m in FIG. 7 against the spring 208 to close the inlet ports 205, 204, and 203 of the bypass passage in succession. Therefore, the compressor 101 is operated at a maximum discharge volume.

When the pressure in the inlet port 124 is reduced below the predetermined pressure, the valve 214 is closed, and the pressure in the control pressure chamber 207 leaks toward the inlet port 124 through a narrow gap 201*a* between the piston 202 and the cylinder 201 and the pressure in the control pressure camber 207 becomes close to the pressure in the inlet port 124.

Since the valve 214 is opened and closed at a very short frequency in the actual operation as in the first embodiment, the piston 202 is balanced at a position corresponding to the cooling load and the compressor 101 is operated at a discharge volume corresponding to the cooling load.

Accordingly, also in the second embodiment, effects similar to those attained in the first embodiment can be attained by a very simple structure.

Figure 8:
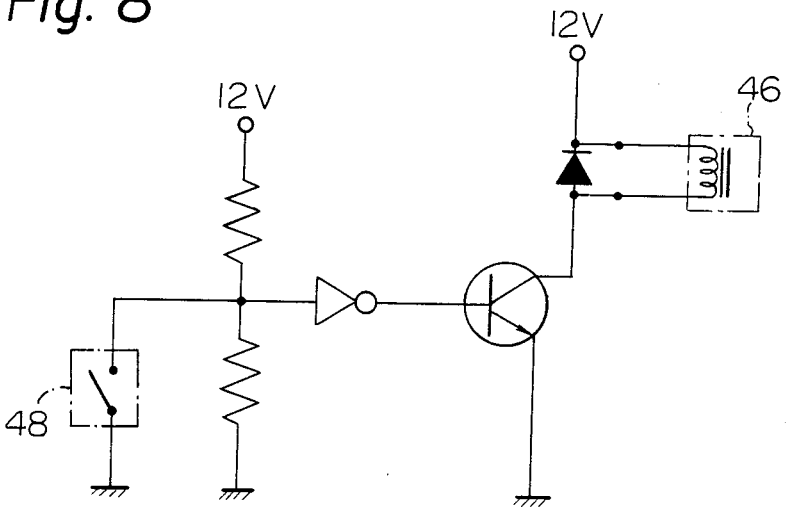
FIG. 8 is a switching circuit diagram of a modification of the relation between the pressure detector and a control valve in the first embodiment.

Incidentally, in the first embodiment, the solenoid coil 46 is directly connected to the switch of the pressure detector 48. In view of the durability of the contact of the switch, there may be adopted a method in which the solenoid coil 46 is connected to the switch of the detector 48 through a switching circuit shown in FIG. 8.

In the foregoing illustration, the predetermined pressure for operating the valves 45 and 214 are set at 1.85 kg/cm$^2$. As is apparent to those skilled in the art, the predetermined pressure is not limited to this value.

Figure 9:
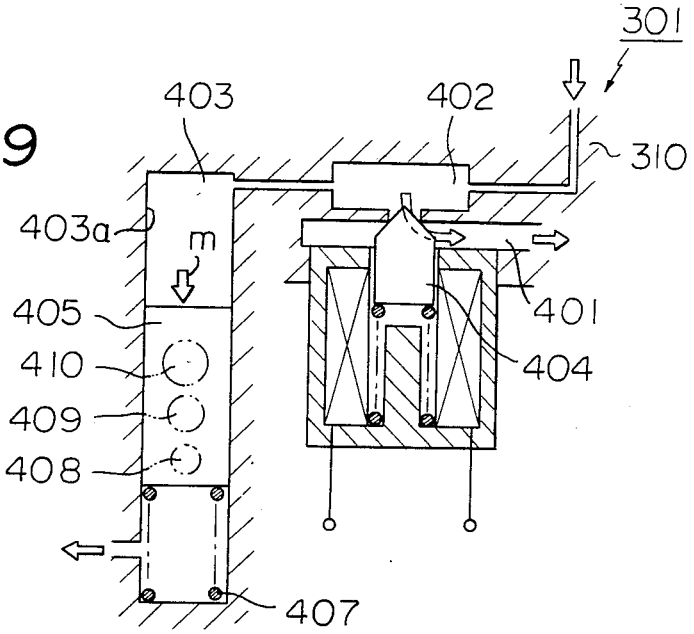
FIG. 9 is a sectional view showing a part of a compressor in a refrigerating apparatus according to a third embodiment of the present invention.

In FIG. 9 is illustrated a part of a third embodiment of the present invention. In this third embodiment, a spill passage 401 is communicated with a control pressure chamber 403 formed in the cylinder 403*a* through a pressure supply passage 402 in a housing 310 of the compressor 301. A control valve 404 is arranged in the spill passage 401. If opening-closing control of the spill passage 401 is performed by the valve 404, pressure in the control pressure chamber 403 is reduced from a pressure conforming to, for example, a pressure in a discharge passage (not shown), to a pressure conforming to a pressure in a suction passage (not shown). A piston 405 formed as a spool-type valve member is operated according to the pressure in the control pressure chamber 403. In the third embodiment, it is not necessary to form a spilling gap between the piston 405 and the cylinder 403*a*.

In the third embodiment, when the cooling load is high and the pressure in the suction passage is higher than the predetermined pressure, the valve 404 is turned off to close the spill passage 401, whereby the pressure in the control pressure chamber 403 is increased up to the pressure in the discharge passage. Accordingly, piston 405 is moved in the direction of arrow m in FIG. 9 against the spring 407 to close the inlet ports 410, 409, and 408 of a bypass passage. Therefore, the compressor is operated at a maximum volume.

In the third embodiment, when the cooling load is low and the pressure in the suction passage is reduced below the predetermined pressure, the valve 404 is turned on to open the spill passage 401, and the refrigerant is spilled from the control pressure chamber 403 into the suction passage through the spill passage 401 and the pressure in the control pressure chamber becomes nearly equal to the pressure in the suction passage. Accordingly, the spool valve 405 is pushed in the direction opposite to the direction of arrow m in FIG. 9 by the spring 407 to open the inlet ports 408, 409, and 410, and the compressor 301 is operated at a minimum discharge amount.

Since the above operation is repeated at a very short frequency, the piston 405 is shaken at small amplitudes with the position of an opening degree maintaining the pressure in the suction passage at the predetermined pressure being as the center, and the compressor 301 is operated at a volume corresponding to the cooling load.

It is to be understood that the particular embodiments herein described are exemplary and illustrative of the invention and certain changes may be made within the range defined in the claims and also within the range obvious to those skilled in the art.

We claim:

1. A compressor for use in a refrigerating apparatus comprising:

a housing having therein at least one movable compression chamber which has a volume varying in accordance with the movement thereof;

a suction passage arranged in said housing and connected to said compression chamber when said compression chamber is in a suction stroke, thereby to feed a refrigerant thereinto;

a discharge port arranged in said housing and connected to said compression chamber when said compression chamber is in a discharged stroke, thereby to discharge the refrigerant therefrom;

a discharge valve provided at the downstream end of said discharge port;

a bypass passage having an inlet portion and an outlet portion which is connected to said suction passage, said inlet portion having an opening which is able to be open to said compression chamber when said compression chamber is in a decreasing volume stroke, thereby to spill the refrigerant from the compression chamber into said suction passage;

valve means having a control pressure chamber formed in said housing and a valve member which is arranged in said inlet portion of said bypass passage and is actuated in response to a variety of pressures of the refrigerant in said control pressure chamber for adjusting the area of the opening of the inlet portion of said bypass passage;

pressure supply means arranged in said housing and connecting said control pressure chamber to said discharge port located upstream of said discharge valve for supplying a refrigerant which pressure is higher than the pressure in said suction passage when said compressor is operating and increasing the pressure in said control pressure chamber;

a spill passage arranged in said housing and interconnecting said control pressure chamber to said suction passage for spilling a part of the refrigerant in said control pressure chamber into said suction passage and decreasing the pressure in said control pressure chamber; and pressure control means having a pressure control valve for controlling the amount of the refrigerant to be supplied into said control pressure chamber;

a pressure sensing means communicating with said suction passage for sensing variation in the pressure in said suction passage; and an activator operatively connected to said pressure sensing means for activating said pressure control valve in response to certain variations in pressure sensed by said pressure sensing means so that said pressure sensing means is biased by suction pressure to activate said pressure control valve so as to supply the refrigerant into said control pressure chamber when said pressure sensing means senses that the pressure in said suction passage is higher than a predetermined pressure.

2. A compressor according to claim 1, wherein said pressure supply means comprises an intermediate pressure space in which a pressure between the pressure in said discharge passage and the pressure in said suction passage is introduced so that a refrigerant, which pressure is higher than the pressure in said suction passage and lower than the pressure in said discharge passage can be supplied into said control pressure chamber.

3. A compressor according to claim 1, wherein said valve means comprises a cylinder formed in said housing, said cylinder having a piston which is slidably arranged therein, and defining therein said control pressure chamber at one end of said piston so that said piston is moved in response to the variation of the pressure in said control pressure chamber, said piston being operatively connected to said valve member which is rotatably supported on said housing, so that said valve member rotates in proportion to the movement of said piston.

4. A compressor according to claim 1, wherein said valve means comprises a cylinder formed in the housing, said cylinder slidably supporting therein a piston which is formed as said valve member and defining therein said control pressure chamber at one end of said piston so that said piston is moved in response to the variation of the pressure in said control pressure chamber for varying the area of the opening of said inlet portion which has a plurality of inlet ports.

5. A compressor according to claim 3, wherein said spill passage comprising a gap which is formed between said piston and said cylinder for always interconnecting said control pressure chamber to said suction passage.

6. A compressor according to claim 1, wherein said pressure control means comprises a pressure control valve which is arranged in said spill passage for controlling the amount of the refrigerant to be spilled from said control pressure chamber so as to control the pressure in said control pressure chamber.

7. A compressor according to claim 1, wherein said pressure sensor has a sensing element for sensing the variety of the pressure difference between the pressure in said suction passage and atmospheric pressure.

8. A compressor according to claim 1, wherein said activator comprises a solenoid coil for actuating said pressure control valve and a switching circuit for switching on-off of energizing of the solenoid coil in response to the detecting output of said detector.

9. A compressor according to claim 1, wherein said pressure control valve is adapted to be urged by a force of a pressure difference between the pressure in said suction passage and atmospheric pressure.

10. A compressor according to claim 1, wherein said housing is provided with a cylindrical bore formed in said housing and a rotor eccentrically and rotatably arranged in said cylindrical bore, said rotor being provided with vanes rotatable therewith for defining said compression chamber therebetween in said housing.

11. A compressor according to claim 1, wherein said refrigerating apparatus comprises a condenser for condensing the refrigerant discharged from said discharge passage of said compressor, a first conduit for interconnecting said discharge passage of said compressor to said condenser, a second conduit for feeding the refrigerant condensed by said condenser to an evaporator, said second conduit including a pressure reducing device for reducing the pressure of the condensed refrigerant and expanding the same, and a third conduit for feeding the refrigerant vaporized in said evaporator into said suction passage of said compressor.

* * * * *